United States Patent [19]

Bouiller et al.

[11] Patent Number: 4,679,982

[45] Date of Patent: Jul. 14, 1987

[54] COMPRESSOR BLOW-OFF ARRANGEMENT

[75] Inventors: Jean G. Bouiller, Brunoy; Gérard E. A. Jourdain, Saintry sur Seine, both of France

[73] Assignee: Société Nationale d'Etude et de Construction de Moteur d'Aviation "S. N. E. C. M. A.", Paris, France

[21] Appl. No.: 773,226

[22] Filed: Sep. 6, 1985

[30] Foreign Application Priority Data

Sep. 6, 1984 [FR] France ..... 84 13694

[51] Int. Cl.[4] ..... F04D 27/02

[52] U.S. Cl. ..... 415/145; 251/358

[58] Field of Search ..... 415/144, 145, 28, 150; 60/39.23, 39.29, 226.1; 251/85, 358

[56] References Cited

U.S. PATENT DOCUMENTS

| | | | |
|---|---|---|---|
| 3,057,541 | 10/1962 | Hasbrouck et al. | 415/145 |
| 3,542,333 | 11/1970 | Stampfli | 251/85 |
| 3,588,268 | 6/1971 | Hampton | 415/145 |
| 3,638,428 | 2/1972 | Shipley | 415/145 X |
| 4,005,612 | 2/1977 | Lippincott | 74/470 |
| 4,086,761 | 5/1978 | Schaut et al. | 60/226.1 |
| 4,390,318 | 6/1983 | Weiler | 415/145 |

FOREIGN PATENT DOCUMENTS

| | | |
|---|---|---|
| 0029773 | 11/1980 | European Pat. Off. . |
| 2060509 | 8/1972 | Fed. Rep. of Germany . |
| 2359973 | 2/1978 | France . |
| 911535 | 11/1962 | United Kingdom . |
| 1357016 | 6/1974 | United Kingdom . |

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

A ring or other annular assembly is supported within a compressor casing by means of one or more resiliently deformable bodies of elastomeric material adhered between two rigid plates. One of the rigid plates is secured to the ring, the other to the compressor casing, and both plates are disposed parallel to the direction of movement of the ring. Preferably, the resiliently deformable body is made up of an alternating stack of the elastomeric plates and rigid plates adhered together, and parallel with the first two rigid plates which secured the body to the ring and the casing. A compressor of a gas turbine plant incorporates an antisurge blow-off valve mechanism in the form of a slot formed in the outer wall defining the flow path and an annular assembly movable axially of the plant to close and open the slot.

9 Claims, 2 Drawing Figures

6
61
63
62
65
86
85
88
18
75
74
87
89
90
81
82
8
112
I

COMPRESSOR BLOW-OFF ARRANGEMENT

BACKGROUND OF THE INVENTION

1. Field of the Invention

The invention relates to a compressor blow-off or discharge arrangement; more specifically the invention relates to means for supporting and guiding a ring serving as a valve member controlling a compressor blow-off or discharge opening.

2. Summary of the Prior Art

In a gas turbine engine it is known to combine with the compressor blow-off valves arranged in association with one or more stages, intended to deflect part of the air flow outwards when the compressor is made to operate outside the range for which it was designed, under a partial load, for example. In this way the so-called "surging" phenomenon, due to the air flows breaking away from the blades and resultant instability of flow, is avoided.

Conventional blow-off means comprise several pivotal flaps distributed over the periphery of the casing defining the flow path and these flaps are synchronously controlled. The flaps should present a substantial flow section, be able to open and close quickly, and provide good seals in the closed position so as to avoid adverse effects on the performance of the engine. To meet these requirements heavy, complex arrangements, of far from negligible overall size are necessary. Moreover, the opening of these flaps creates in the air flow turbulence and other phenomena such as heterogeneity which may disturb the operation of any downstream compressor.

One prior proposal consists in making axial movement arrangements comprising a ring-shaped valve surrounding the casing defining the air flow path, and the axial motion of which, which may be combined with rotation, uncovers a slot or other opening in the periphery of the flow path. By this means it is possible to control a substantial flow of air over the relatively short range of movement of the ring, the overall size of which is small; finally, a better distribution of the stresses together with a simpler construction is achieved.

Such a ring or other annular assembly, having a substantial diameter, is actuated by a plurality of actuators distributed over its periphery. Usually, it is supported and guided for movement by means of slides or rollers cooperating with other sliding or rolling surfaces. U.S. Pat. No. 588,268, for example, discloses a guide arrangement in which slides, evenly distributed over the radially inner face of the ring, are mounted to slide on longitudinal ribs added on the outer wall of the casing. Patent DE-A-2 060 509 also shows guide means in which rails rigid with the ring cooperate with rollers mounted on the casing.

Such means are not satisfactory as they are subject to wear and to jamming owing to clogging up as a result of particles which insert themselves between the relatively sliding surfaces. The inevitable deformations at diameters of this order also bring about jamming which effectively locks the mechanism. Finally, the ring is not adequately supported with the necessary degree of rigidity because of the play necessary for satisfactory operation, which permits the development of vibrations.

An object of the invention is to overcome the disadvantages of prior proposals.

SUMMARY OF THE INVENTION

According to the present invention there is provided in an axial flow compressor of a turbo-jet engine, a compressor casing, means defining inner and outer walls of the air flow path having an annular opening therein for controlled blow-off of the air flow, an annular movable assembly for opening and closing the said annular opening, and means supporting the annular assembly on the compressor casing, said support means comprising a resiliently deformable body with at least one elastomer plate, and at least two rigid plates secured to opposed faces of the elastomer plate, one of the rigid plates being secured to the annular assembly and the other rigid plate being rigid with the said casing, all the plates lying in planes parallel to the direction of movement of the annular assembly.

Preferably, the resiliently deformable body is made up of stack of alternate elastomer plates and rigid plates adhered together and parallel with the first two plates which provide for attachment to other parts of the assembly. The centering of the ring may be ensured by the combination of at least three bodies distributed peripherally, the plates of which are arranged radially.

Such a laminated body or block is already known per se, its design is based on the property possessed by elastomers or the like to counteract low shear strength. Thus, by correctly choosing the dimensions of the various elements and their number, blocks are made which transmit practically without deformation loads applied normal to the plates and which can be deformed through the sliding of rigid plates, parallel to one another, opposing resilient return forces.

By using such a block risks of jamming are eliminated, which makes the operation of the arrangement more reliable, and as a result maintenance is reduced. Moreover, this material being less subject to wear, the working life of the arrangement is increased. Finally, owing to non-compressibility in the transverse direction, accurate guidance of the ring is achieved and the ring remains insulated from any vibrations produced in the casing.

It is possible to select the characteristics such that the return force exerted by the deformable body, when the ring is moved from its closed position to the open position, will be sufficient to permit the automatic return of the ring to its closed position in the event of failure of the actuating mechanism. This is a safety factor in an aircraft and prevents possible losses of thrust during critical flight stages.

Additionally, if the blocks are pre-stressed on assembly, they ensure locking of the ring in the closed position even in the event of failure of the actuating mechanism.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
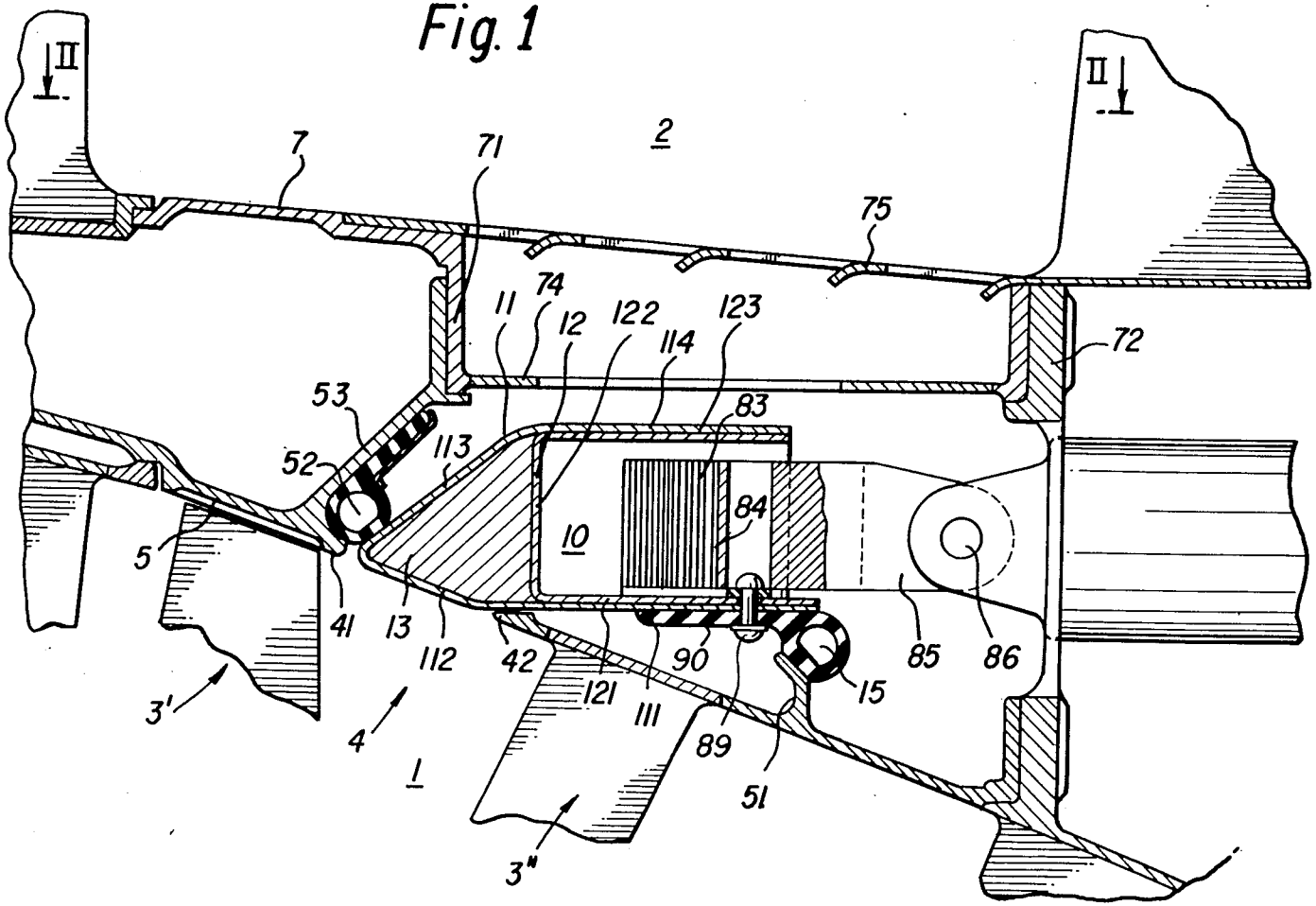
FIG. 1 is a longitudinal section of the outlet portion of the compressor of a twin flow turbo jet engine.

FIG. 1 is an axial section of an outlet portion of the intermediate pressure compressor of a twin-flow turbo jet engine with a high dilution ratio. The air delivered from the low pressure compressor is divided into a primary and secondary flows. The primary flow is compressed by the intermediate pressure compressor, and the high pressure compressor is series-mounted downstream thereof. The air then passes into the combustion chamber (not shown) and the successive turbine stages before being exhausted to atmosphere.

The secondary flow is exhausted directly to atmosphere and supplies the main part of the thrust of the engine. In FIG. 1 a partial representation is given of the path 1 of the primary flow, and the path 2 of the secondary flow. The intermediate pressure compressor 3, of which it is possible to see the tip portion of a rotor blade 3' of the last stage, and the end of a stator nozzle guide vane 3'', is mechanically independent of the high pressure compressor, not shown, situated downstream.

It may happen that at certain operational stages of the engine, on starting, for example, that the ranges of operation of the compressors no longer match one another, and that the high pressure compressor cannot accommodate the air delivered by the medium pressure compressor. To prevent the development of the well known surging phenomenon, part of the air is blown-off or exhausted downstream of the medium pressure rotor by opening a valve establishing communication between air flow paths 1 and 2.

This valve comprises a ring 10 cooperating with an annular slot 4 provided in the outer wall 5 of the flow path 1. This slot has "parallel" edges 41,42, each lying in a respective plane perpendicular to the axis of the engine. In the embodiment illustrated, the slot occupies a strip, is frusto-conical and lies between the rotor blade 3' and statue nozzle guide vane 3''.

An annular assembly or ring is axially movable within a space defined by wall 5 and inner wall 7 of the air flow path 2, and upstream, by a frusto-conical member 53 connecting wall 5 at the edge 41, to a radial flange 71 of the wall 7 and, downstream, by a radial flange 72 connecting walls 5 and 7. An internal cylindrical member 74 interconnects the radial flanges 71 and 72. The member has cut-away portions, as may be seen from FIG. 1 for the passage of the deflected air which passes through the wall 7, and through outflow grids 75 made up of sectors assembled peripherally in an annular cut-away in the casing constituting the wall 7. These sectors have vanes arranged in parallel rows and inclined so that the air blown-off or exhausted disturbs flow in the secondary flow path as little as possible.

The ring 10 is of channel section and is orientated so that the limbs thereof are parallel to the axis of the engine. The ring is made with two skins 11 and 12 of sheet metal, or preferably, of a composite material of concave section, the skins being nested one into the other so as to define a cavity 13. This cavity has a filler serving to reinforce the ring, for example a synthetic resin loaded with hollow glass balls. The outer skin 11 has an inner limb 111 of cylindrical shape, the diameter of which corresponds to that of an outer seating provided on the wall 5 at the edge 42. The limb 111 is extended by a frusto-conical section 112 the cone-angle of which corresponds to that part of wall 5 which is omitted to form slot 4. A second portion of the outer skin 113 is again frusto-conical and ends in a second cylindrical limb 114 concentric with the first, but with a larger diameter.

The second skin 12 also has two limbs 121 and 123 made integral by any suitable means—riveting, glueing, and so on—with the limbs 111 and 114. The annular cavity 13 is thus defined by the skin 11 and part 122 of the skin 12 inter-connecting the limbs 121 and 123.

The ring 10 is movable in translation within the member 74 between a first position in which the section 112 seals the slot 4 and a retracted position clearing the latter. In said first position the fluid-tightness of air flow path 1 is provided by two ring beadings or seals. The ring seal or beading 15 mounted on the inner face of the ring abuts a radial flange 51 of wall 5. The ring seal or beading 52 housed in the angle formed by the member 53 and the wall 5 acts as a support for the forward end of the ring. The latter is driven by several axial actuators 6, of screw type, synchronised, and evenly distributed over the periphery. The actuators are at least three in number, preferably six. The body 61 of each actuator is secured to the radial flange 72; the latter has openings which allow the passage of two actuator rods 62, one end of which is fixed to a guide 63 sliding in a lateral slideway of the body 61, and the other end of which is connected to the ring 10.

The ring 10 is supported in the casing by means of resiliently-deformable bodies 8, which serve also as guides during movement from the open position to the closed position. Each body is made up of two blocks 81,82 formed by alternate layers, parallel with the axis of the ring, of plates in an elastomeric material 83, and of rigid plates 84, of metal, for example, vulcanized together or bonded or secured any other means. These laminated blocks are of parallelepipedic shape and are assembled by their end metal plate 85 so as to constitute a V-shaped body the opening of which is directed upstream. The plates 85 of the top of the body are secured by a shaft 86 to a plate 66 rigid with the body of the actuator 61. Each end of each branch of the V has two metal plates 87, welded together, the downstream end of which opens out so as to form a plate 88 which matches that of the end of the rods 62 of the actuator 6. These plates 87 also have legs 90 by means of which they are secured by adhesive, rivet members 89 or any other means to the limbs of the ring. On assembly, the blocks are prestressed so that, being already in a closed position, shown on the upper section of FIG. 2, a return force is exerted on the ring.

The arrangement operates as follows:

In the closed position, the rods 62 of the actuators 6 force the ring 10 upstream into abutting relation with the ring seals 15 and 52.

To effect opening of the discharge arrangement the six actuators 6 are operated simultaneously. The rods of the actuators move downstream effecting the sliding of the ring 10 and the opening of the annular slot through which the blow-off exhaust of the compressor takes place. The ring 10 is guided by the laminated blocks 81, 82 which are progressively deformed. Reference to the lower half of FIG. 2 will show the two extreme configurations (one in chain lines) adopted by these blocks.

The elasticity of these blocks 81, 82 is at a maximum in a direction parallel with the plane of the plates which make up the blocks, but it is at a minimum in a direction perpendicular to these planes. The centering of the ring 10 is effected by the combination of the six bodies 8 the plates 87 of which are disposed radially.

Figure 2:
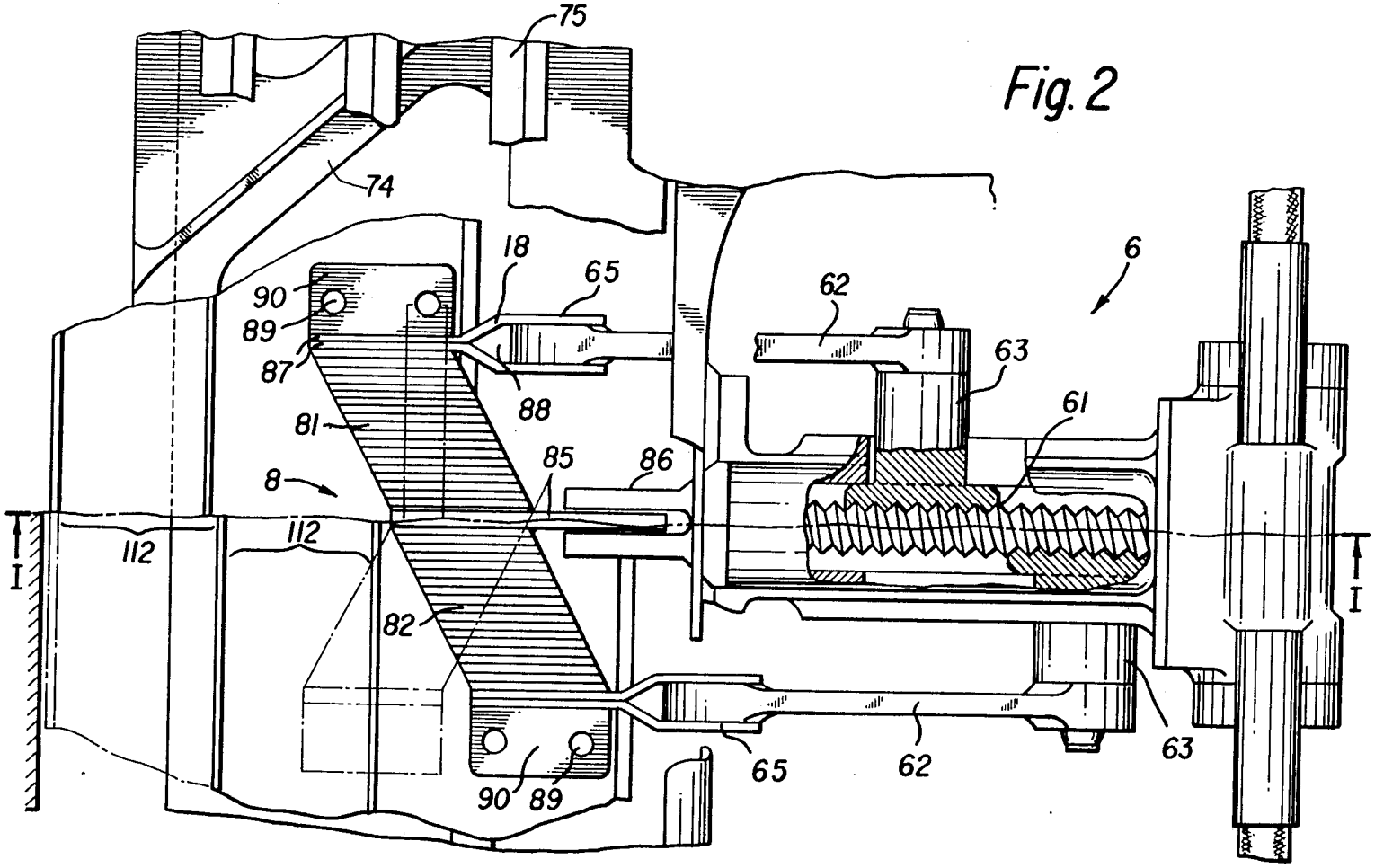
FIG. 2 is a fragmentary, developed view, with parts broken away viewed from the plane indicated by arrows II—II of FIG. 1; an annular assembly thereof being shown half in the open position, half in the closed position.

To ensure the integrity of the laminated blocks 81 and to reduce the risk of the adhered plates coming apart, it is necessary to prevent them becoming subject to elongation stresses across the plates. The V-arrangement enables them to work substantially in compression while allowing a significant range of movement of the ring. This movement range corresponds to the symmetrical inversion of the branches of the V as represented in FIG. 2.

Moreover, on assembly, the resiliently deformable blocks are prestressed so that, when in the closed position, the ring is subjected to a thrust force against the seals. Thus, vibrations and any untimely opening in the event of the release of the actuators, are avoided. In the event of failure of the control when the ring is in the open position the return force is sufficient to bring about closure of the slot by the ring.

It is obvious that the embodiment described hereinbefore and shown on the accompanying drawings is given only for guidance and is not limitative. The invention also covers all equivalent methods of construction within the ability of the specialist. No departure will be made from the scope of the invention by altering, for example, the shape and the arrangement of the deformable body, or by applying the invention to a ring valve or to a ring segment of a different structure.

What is claimed is:

1. An axial flow compressor of a turbo-jet engine, comprising:

a compressor casing, means defining inner and outer walls of the air flow path having an annular opening therein for controlled blow-off of the air flow, an annular movable assembly for opening and closing the said annular opening, and means supporting the annular assembly on the compressor casing, said support means comprising a resiliently deformable body with at least one elastomer plate, and at least two rigid plates secured to opposed faces of the elastomer plate, one of the rigid plates being secured to the annular assembly and the other rigid plate being rigid with the said casing, all the plates lying in planes parallel to the direction of movement of the annular assembly.

2. A compressor according to claim 1, wherein the resiliently deformable body comprises a stack of said elastomer plates alternating with said rigid plates, wherein adjacent plates are adhered together.

3. A compressor according to claim 1, wherein the dimensioning and the arrangement of the deformable body are such that sufficient return force is exerted to bring the annular assembly back from the open position to the closed position.

4. A compressor according to claim 1, wherein the deformable body is prestressed on assembly so as to bias the ring in the closed position to make pressure contact with the opening.

5. A compressor according to claim 1 wherein the annular assembly is supported by at least three said resiliently deformable bodies the plates of which are radially orientated.

6. A compressor according to claim 1 wherein the annular assembly is movable by at least one actuator and the assembly is supported by means of said actuators which is jointly associated with the said resiliently deformable body.

7. A compressor according to claim 6 wherein each actuator comprises two slidable rods, the corresponding deformable body being mounted between said rods on either side of means for securing the block of the actuator, the latter being rigid with the compressor casing.

8. A compressor according to claim 7, wherein the deformable body is of V shape and includes a centre plate by which it is secured to the actuator and to the annular assembly by the ends of the branches of the said V.

9. A compressor according to claim 1, wherein the channel includes limb members and wherein the annular assembly is of channel shape, and the deformable body is housed between said limb members of the channel.

* * * * *